US005472096A

United States Patent [19]

Prinsloo

[11] Patent Number: 5,472,096

[45] Date of Patent: Dec. 5, 1995

[54] SPIRAL CONCENTRATOR

[75] Inventor: Trevor R. Prinsloo, Kempton Park, South Africa

[73] Assignee: Multotec Cyclones (PTY) Limited, South Africa

[21] Appl. No.: 275,980

[22] Filed: Jul. 15, 1994

[51] Int. Cl.[6] ..... B03B 5/52; B07C 9/00

[52] U.S. Cl. ..... 209/459; 209/697

[58] Field of Search ..... 209/458, 459, 209/493, 696, 697

[56] References Cited

U.S. PATENT DOCUMENTS 4,476,980 10/1984 Giffard ..... 209/697 X
4,545,900 10/1985 Wright ..... 209/459
4,664,789 5/1987 Lees et al. ..... 209/697 X

FOREIGN PATENT DOCUMENTS 2100624 1/1983 United Kingdom ..... 209/697

*Primary Examiner*—William E. Terrell
*Assistant Examiner*—Tuan Nguyen
*Attorney, Agent, or Firm*—Banner & Allegretti, Ltd.

[57] ABSTRACT

A spiral concentrator (1) comprising a spiral trough (2) mounted on a central column (3) which is characterized therein that, in comparison with a conventional trough having a profile (11) which is generally concave and which slants downwardly from an outer edge of the trough towards a central column, the profile (8) of the trough is deepened in a section of the trough adjacent the central column of the concentrator.

5 Claims, 4 Drawing Sheets

SPIRAL CONCENTRATOR

FIELD OF THE INVENTION

This invention relates to a spiral concentrator and more particularly, but not exclusively, to a spiral concentrator for beneficiating fine coal.

BACKGROUND TO THE INVENTION

Generally, a spiral concentrator of this kind comprises a spiral trough mounted on an upright central column. In a conventional concentrator the profile of the trough is generally concave and slants downwardly from the outer edge of the trough towards the central column, except in a zone immediately adjacent the central column where the trough has an inner lip which slopes upwardly. This profile will in this specification be referred to as a "conventional trough profile".

It has been proposed to alter the conventional trough profile by forming a relatively narrow, separate channel immediately adjacent the central column of a spiral concentrator. Such a channel is separated from the trough proper by means of an upstanding ridge in which splitters are provided along the height of the concentrator. The splitters are intended to divert heavier and/or larger particles from the feed material being beneficiated. A disadvantage of such an arrangement is that the use of splitters not only increases the cost of the concentrator but it is also inconvenient and not cost effective to have to set and adjust the splitters from time to time. Furthermore, the narrow channel can also trap a fraction of the beneficial product being separated, which fraction is then lost, resulting in a decrease in efficiency of the concentrator.

OBJECT OF THE INVENTION

It is accordingly an object of the invention to provide a spiral concentrator with which the abovementioned disadvantages are sought to be overcome or at least diminished.

SUMMARY OF THE INVENTION

A spiral concentrator according to the invention comprises a spiral trough mounted on a central column which is characterized therein that, in comparison with a conventional trough having a profile which is generally concave and which slants downwardly from an outer edge of a trough towards a central column, the profile of the trough is deepened in a section of the trough adjacent the central column of the concentrator.

In a preferred form the deepened section of the trough profile comprises a rectilinear section along a greater part of its width which merges with an arcuate inner lip of the trough immediately adjacent the central column.

The deepened section of the trough profile preferably extends approximately one third of the width of the trough from the central column and the deepening of the deepened section at the merger of the rectilinear section and the arcuate inner lip is preferably in the range of 10 mm to 16 mmm.

It is a further feature of the invention that the trough profile according to the invention is deepened compared with the conventional trough profile in a second section adjacent the free edge of the trough. The second section may be arcuate in form and may extend over approximately one half of the width of the trough from an outer upright lip of the trough.

BRIEF DESCRIPTION OF THE DRAWINGS

A preferred embodiment of the invention will now be described by way of example with reference to the accompanying drawings in which.

DETAILED DESCRIPTION OF PREFERRED EMBODIMENT

Figure 1:
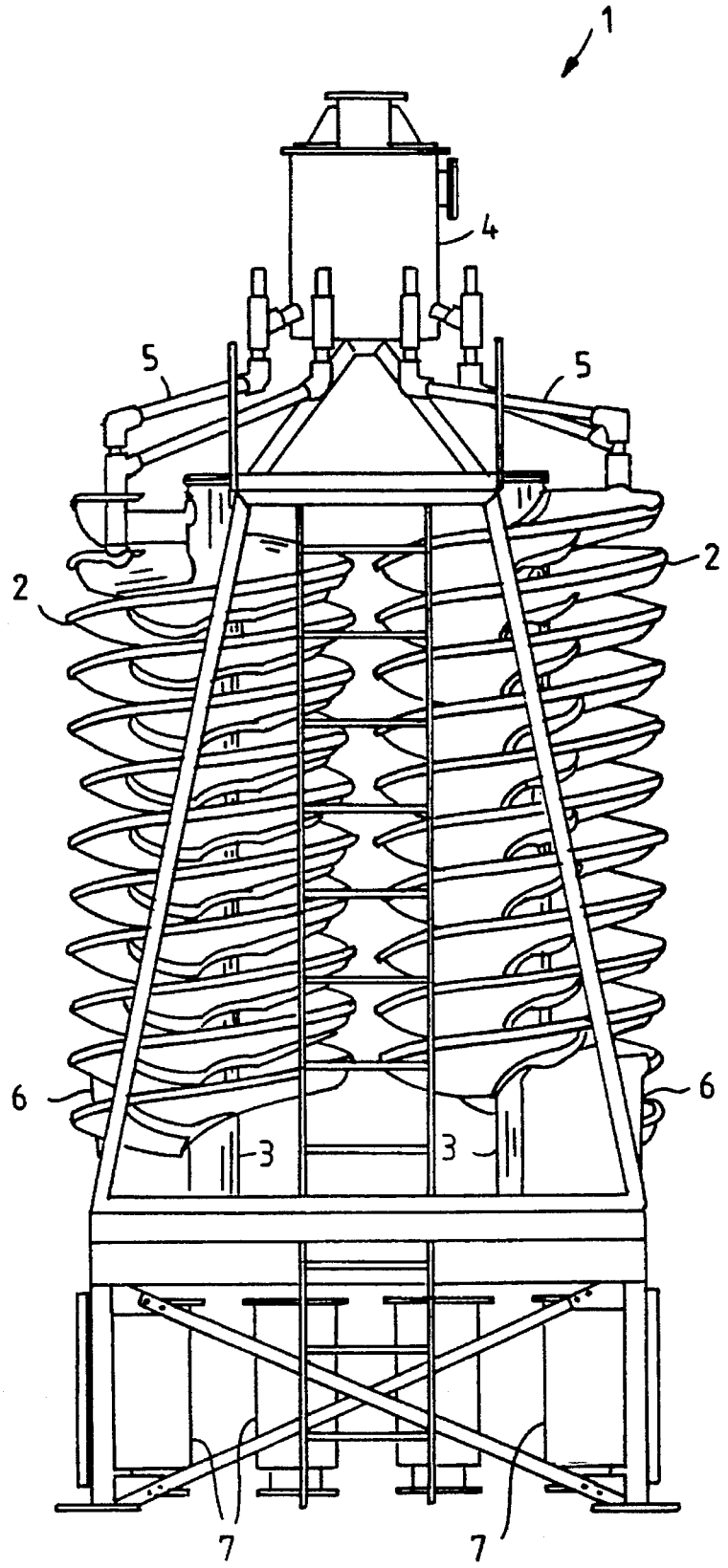
FIG. 1 is an elevation of a spiral concentrator of the kind in which the invention can be applied.

With reference to FIG. 1, a spiral concentrator 1 has two banks of concentrators each comprising double start spiral troughs 2 mounted on a central column 3. The spiral troughs 2 are fed with water borne slurry to be beneficiated from a central tank 4 via supply pipes 5.

In concentrators of this kind the slurry is usually separated into three fractions, namely refuse, middlings and product, which are received in product boxes 6 located at the base of the spirals from where the fractions are fed to receptacles 7.

Figure 2:
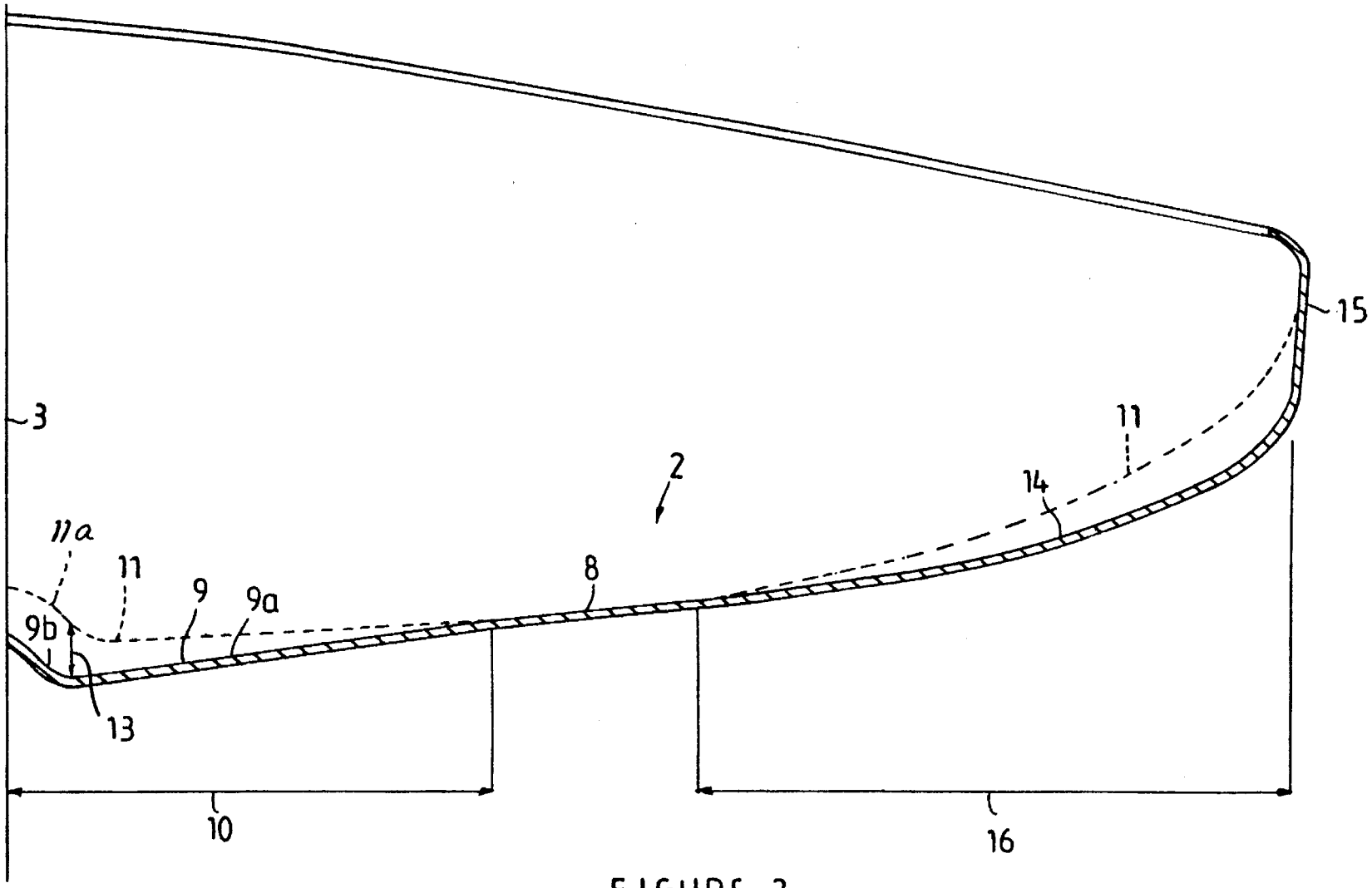
FIG. 2 is a diagram showing the profile of a spiral trough used in the concentrator of FIG. 1 and embodying the invention, and wherein a conventional trough profile is indicated in broken lines.

It is the special feature of the invention that the profile of the spiral troughs 2 is altered from the conventional trough profile to enhance the efficiency of the concentrator. This is achieved in the first instance by providing a deepened section 9 in the trough profile 8 in a section of the trough adjacent the central column 3 (FIG. 2). The deepened section 9 in this embodiment of the invention extends approximately one third of the width of the trough as indicated by numeral 10.

In order best to illustrate the deepened section 9 in the trough profile 8, a conventional trough profile is shown in FIG. 2 in broken lines and identified by numeral 11. As indicated by numeral 11, the conventional trough profile is generally concave in shape and slants downwardly from an outer, upright lip 15 of the trough towards the central column 3, except in a zone immediately adjacent the column where the conventional trough profile has an inner lip 11*a* which slopes upwardly.

In this embodiment of the invention the deepened section 9 in the trough profile 8 comprises a substantially rectilinear section 9*a* which extends a greater part of the width of the deepened section and which merges with an arcuate, inner lip 9*b* of the trough profile located immediately adjacent the central column 3.

In the case of a trough 2 with a diameter of 1 meter, the preferred deepening of the trough profile 8 at the merger of the rectilinear section 9*a* and the inner lip 9*b*, indicated by numeral 13, is in the range of 10 mm to 16 mm and is preferably 13 mm.

The trough profile 8 is further characterized in that it has a second deepened section 14 adjacent the outer, upright lip 15 of the trough. The deepened section 14 is again shown with reference to a conventional trough profile in broken lines indicated by numeral 11. The deepened section 14 is arcuate in form and extends about one half of the width of the trough profile as indicated by numeral 16. The preferred deepening of the section 14 is the same range as in the section 9 described above.

Figure 3:
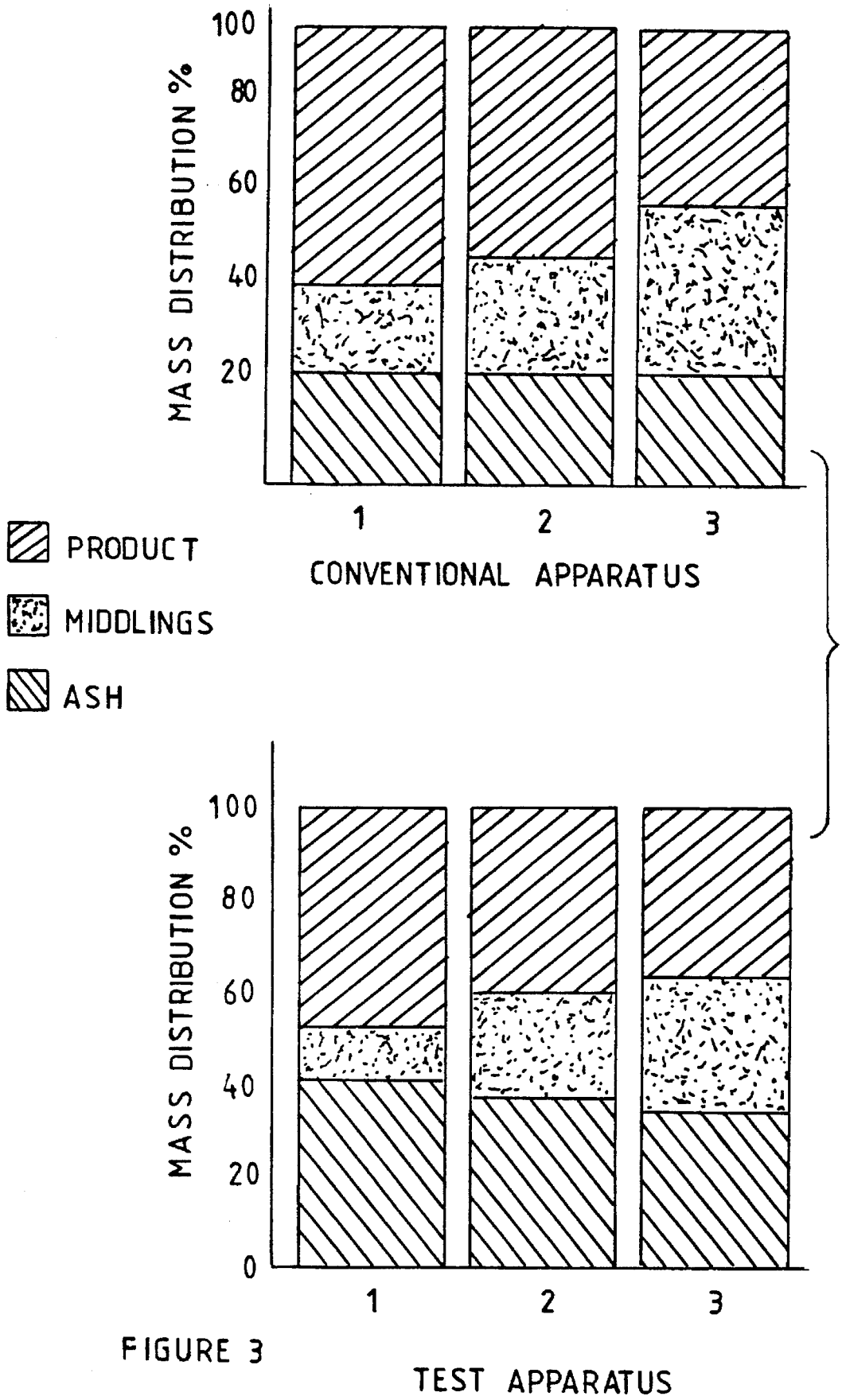
FIG. 3 is an histogram showing test results achieved with a test apparatus embodying the invention in comparison with conventional apparatus.

The applicant has conducted tests with test apparatus containing a spiral trough formed in accordance with the invention and described above, and has compared the results of such tests with those obtained from conventional apparatus. These are illustrated in FIGS. 3 and 4.

The tests were conducted with three grades of slurry containing fine coal (−1,0 mm, +0,1 mm) and a high concentration of ash. The tests are designated by numerals 1, 2 and 3 in FIG. 3 in which the mass distribution obtained in each test is shown both for the test apparatus and for the conventional apparatus. As will be seen from FIG. 3, superior mass distributions were obtained with the test apparatus in that a greater proportion of ash was separated in each case.

Figure 4:
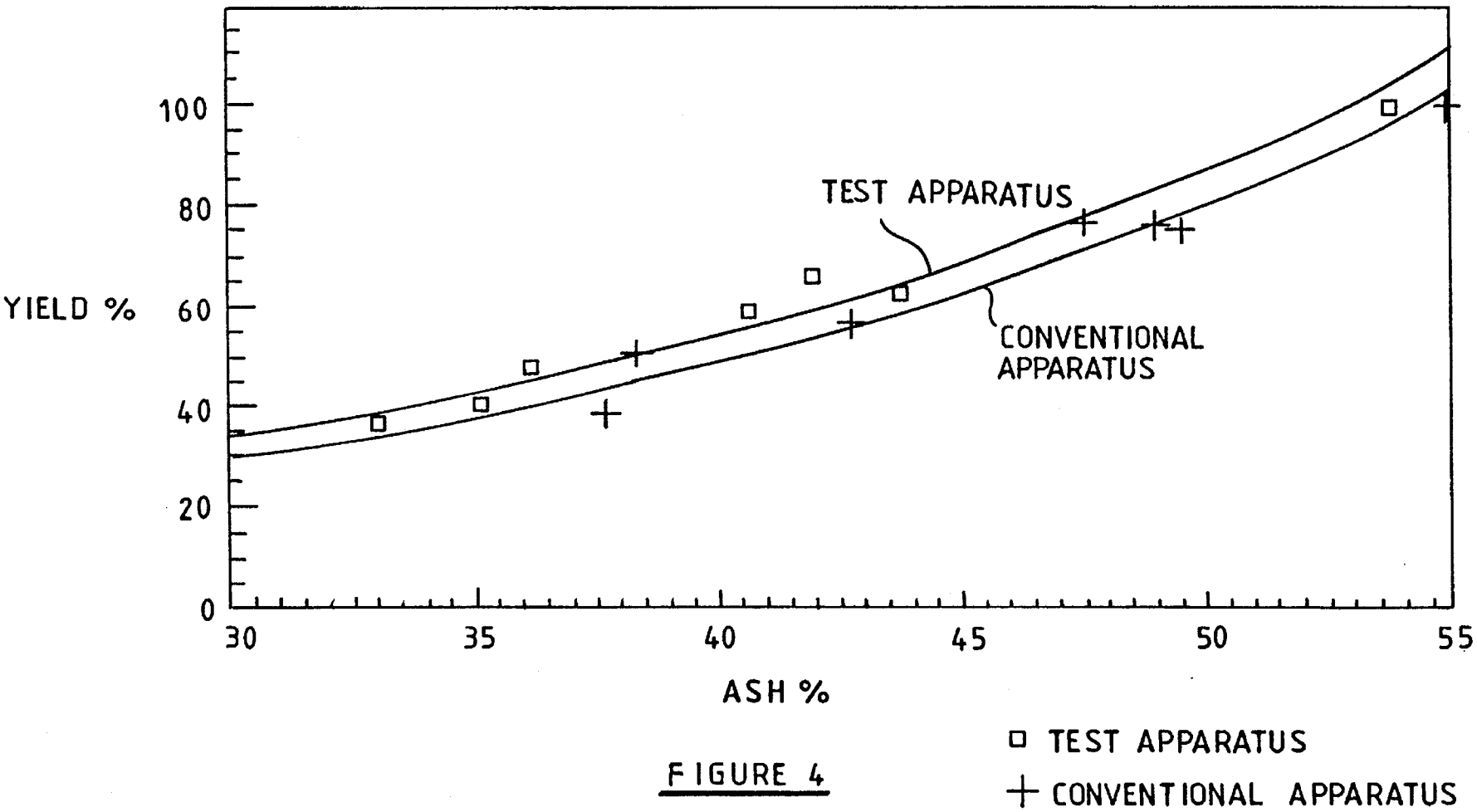
FIG. 4 is a graph further illustrating the test results of FIG. 3.

In FIG. 4 data from the tests referred to above has been plotted to indicate the percentage product yield of the test apparatus and of the conventional apparatus against the ash content. As will be seen from FIG. 4, the test apparatus consistently gave a better product yield for a given ash content.

Without wishing to be bound by theory, the applicant believes that during operation of a spiral concentrator of this kind a circular transverse flow of particles takes place across the width of the trough in addition to the flow of particles along the spiral length of the trough. By providing a deepened section adjacent the central column of the trough, heavier particles are enabled to concentrate in the deepened section whilst lighter particles are enabled to migrate outwardly towards the edge of the trough. It is therefore believed that the separation of finer particles using the trough of the invention is enhanced whilst the increased flow of slurry in the deepened section assists in transporting heavier and/or larger particles which normally tend to lodge on the inner lip of the trough adjacent the central column.

It is also considered that the second deepened section 14 adjacent the outer edge of the trough increases the capacity of the trough.

Thus the invention provides a useful improvement over prior art spiral concentrators.

Many other embodiments of the invention may be made without departing from the scope of the invention described in the appended claims.

I claim:

1. A spiral concentrator comprising a spiral trough mounted on a central column which in comparison with a conventional trough has a profile which is generally concave and which slants downwardly from an outer edge of the trough towards a central column, is deepened in a first section of the trough adjacent the central column of the spiral concentrator, said trough profile being deepened compared with the conventional trough profile in a second section adjacent an outer edge of the trough, said second section a arcuate in form and extending over approximately one half of the width of the trough profile from the outer edge of the trough.

2. A spiral concentrator as claimed in claim 1 in which the deepened section of the trough profile comprises a rectilinear first section along a greater part of its length which merges with an arcuate inner lip of the trough immediately adjacent the central column.

3. A spiral concentrator as claimed in claim 2 in which the deepened first section of the trough profile extends approximately one third of the width of the trough from the central column and in which the deepening of the first section is in the range of 10 mm to 16 mm when measured in a vertical line from the merger of the rectilinear section and the arcuate inner lip to a corresponding arcuate inner lip of the conventional trough.

4. A spiral concentrator comprising;

a spiral trough mounted on a central column which, in comparison with a conventional trough having a profile which is generally concave and which slants downwardly from an outer edge of the trough towards a central column, is deepened in a first section of the trough adjacent the central column of the concentrator, the first section of the trough profile, which extends approximately one third of the width of the trough from the central column, comprising a rectilinear section along a greater part of its length which merges with an arcuate inner lip of the trough immediately adjacent the central column, the trough profile further being deepened compared with the conventional trough in a second section adjacent an outer edge of the trough, the second section being arcuate in form and extending over approximately one half of the width of the trough profile from the outer edge of the trough.

5. A spiral concentrator as claimed in claim 4 in which the deepening of the first section is in the range of 10 mm to 16 mm when measured in a vertical line from the merger of the rectilinear section and the arcuate inner lip to a corresponding arcuate inner lip of the conventional trough.

* * * * *